US006349931B1

(12) United States Patent
Kuo et al.

(10) Patent No.: US 6,349,931 B1
(45) Date of Patent: Feb. 26, 2002

(54) AUTOMATIC PAPER FEEDING SYSTEM

(75) Inventors: Ying-Hsien Kuo, Taipei; Tsung-Te Lin, San-Chung, both of (TW)

(73) Assignee: Acer Communications and Multimedia Inc., Taipei (TW)

( * ) Notice: Subject to any disclaimer, the term of this patent is extended or adjusted under 35 U.S.C. 154(b) by 0 days.

(21) Appl. No.: 09/708,118

(22) Filed: Nov. 8, 2000

(30) Foreign Application Priority Data

Mar. 17, 2000 (TW) ..... 89104913 A

(51) Int. Cl.[7] ..... B65H 7/08
(52) U.S. Cl. ..... 271/110; 271/121; 271/127
(58) Field of Search ..... 271/110, 118, 271/121, 124, 127

(56) References Cited

U.S. PATENT DOCUMENTS 5,253,854 A * 10/1993 Tanoue et al. ..... 271/121
5,358,230 A * 10/1994 Ikemori et al. ..... 271/121
5,386,983 A * 2/1995 Ando ..... 271/118
5,501,444 A * 3/1996 Yurimachi et al. ..... 271/127
6,260,839 B1 * 7/2001 Araki et al. ..... 271/121

* cited by examiner

*Primary Examiner*—H. Grant Skaggs
(74) *Attorney, Agent, or Firm*—Winston Hsu

(57) ABSTRACT

An automatic paper feeding system has a paper-grabbing device and paper-separating device, with a paper tray having a front end that can move up and down. A paper-feeding channel is in front of the front end of the paper tray. The paper-grabbing device is installed on the paper tray and moves paper in the paper tray into the paper-feeding channel. The paper-separating device has a paper-separating roller and a paper-separating friction disk which are respectively installed above and below the paper-feeding channel. These elements together permit only a single sheet of paper to move forward. An actuator mechanism installed under the paper-feeding channel lifts up or pulls down the front end of the paper tray and the paper-separating friction disk. Finally, a driving device drives the paper-grabbing device, the paper-separating device and the actuator mechanism. When the driving device is activated, the actuator mechanism lifts up both the front end of the paper tray and the paper-separating friction disk, and paper placed in the paper tray comes into contact with the paper-grabbing device. The paper-grabbing device moves the paper into the paper-feeding channel. The paper-separating friction disk contacts the paper-separating roller, and the paper-separating roller moves a single sheet along the paper-feeding channel.

12 Claims, 5 Drawing Sheets

AUTOMATIC PAPER FEEDING SYSTEM

BACKGROUND OF THE INVENTION

1. Field of Invention

The present invention provides an automatic paper feeding system and, in particular, discloses an automatic paper feeding system that can simultaneously control paper-grabbing and paper-separating functions.

2. Description of the Prior Art

Business machines are often used in offices to help with the processing of documents. These business machines include copiers, fax machines, printers, etc. To facilitate continuous document processing, these business machines all have paper feeding systems to supply paper. Since most types of business machines can only process a single-paged document a page at a time, the paper feeding system of the machine must be able to send exactly one sheet of paper each time to the machine. If the paper feeding system sends out more than one sheet of paper at a time, the sheets are likely to jam in the machine, causing delays in the entire document handling process, as well as wasting paper. Therefore, it is of great importance that a paper feeding system that can feed exactly one sheet of paper at a time be designed.

Please refer to FIG. 1, which is a side view of a paper feeding system of the prior art. This conventional paper feeding system 10 comprises a paper tray 12, a lift plate 14 rotatably fixed in the paper tray 12, a lift rod 16, and a pick-up roller 18. When the lift rod 16 rotates counterclockwise, the front end of the lift plate 14 is lifted up so that the pick-up roller 18 touches the topmost paper on the lift plate 14 and feeds the paper out of the paper feeding system 10.

Please refer to FIG. 2, which is a side view showing the situation when a conventional paper feeding system feeds multiple sheets of paper. Since the conventional paper feeding system 10 uses only the pick-up roller 18 to deliver the paper 11, it is likely to feed several sheets of paper from the paper feeding system 10. This leads to multiple paper feeding, and the sheets may jam in the paper-feeding channel. Multi-feeding and paper jams result in wastage of paper, are troublesome for the user, and may also reduce the lifetime of the machine.

SUMMARY OF THE INVENTION

It is therefore a primary objective of the present invention to provide an automatic paper-feeding system that can simultaneously control paper-grabbing and paper-separating actions in order to solve the above-mentioned drawbacks of the prior art.

Briefly, the present invention discloses an automatic paper feeding system with a paper-grabbing device and paper-separating device, and a paper tray having a front end that can move up and down. A paper-feeding channel is in front of the front end of the paper tray. The paper-grabbing device is installed on the paper tray and moves paper in the paper tray into the paper-feeding channel. The paper-separating device has a paper-separating roller and a paper-separating friction disk which are respectively installed above and below the paper-feeding channel. These elements together permit only a single sheet of paper to move past. An actuator mechanism installed under the paper-feeding channel lifts up or pulls down the front end of the paper tray and the paper-separating friction disk. Finally, a driving device drives the paper-grabbing device, the paper-separating device and the actuator mechanism. When the driving device is activated, the actuator mechanism lifts up the front end of the paper tray and the paper-separating friction disk, and paper placed in the paper tray comes into contact with the paper-grabbing device. The paper-grabbing device moves the paper into the paper-feeding channel. The paper-separating friction disk upwardly contacts the paper-separating roller, and the paper-separating roller moves a single sheet along the paper-feeding channel.

It is an advantage of the present invention that the operation of the actuator, paper grabbing-device and paper-separating device together insure that only a single sheet of paper is fed to a device. Furthermore, the design of the present invention reduces the number of components required for the paper feeder, thus reducing overall product costs.

These and other objectives and advantages of the present invention will no doubt become obvious to those of ordinary skill in the art after reading the following detailed description of the preferred embodiment, which is illustrated in the various figures and drawings.

DETAILED DESCRIPTION OF THE INVENTION

Figure 1:
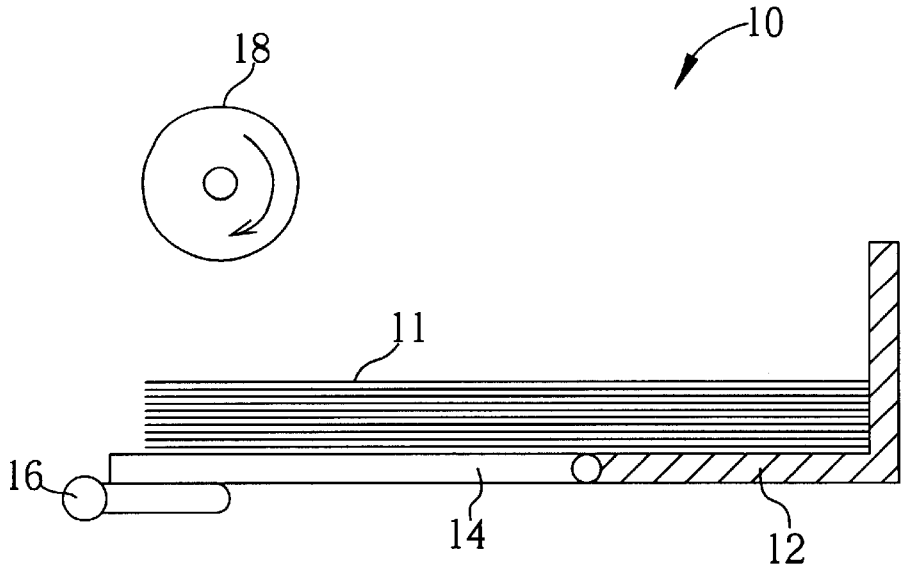
Fig. 1 Prior art
FIG. 1 is a side view of a conventional paper feeding system.
Figure 2:
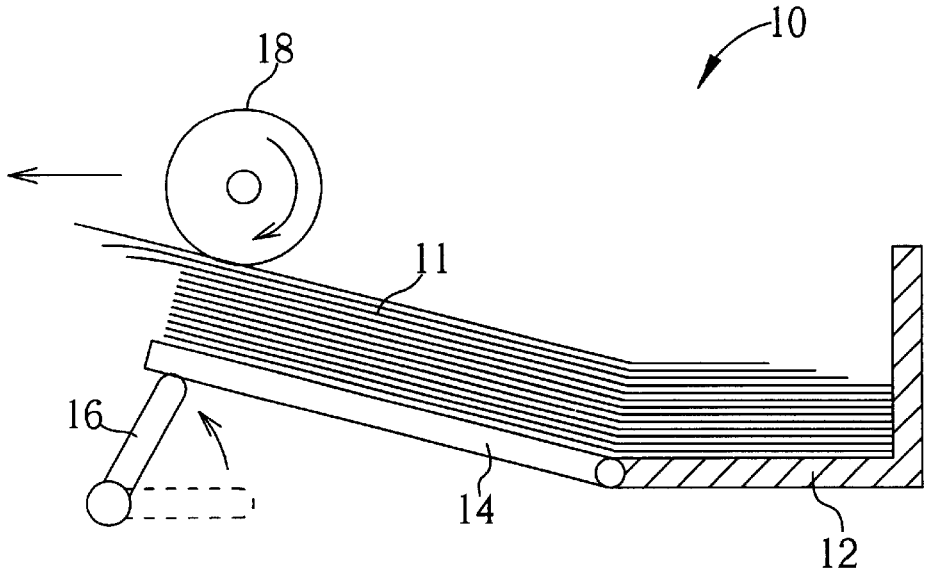
Fig. 2 Prior art
FIG. 2 is a side view showing a conventional paper feeding system feeding multiple sheets of paper.
Figure 3:
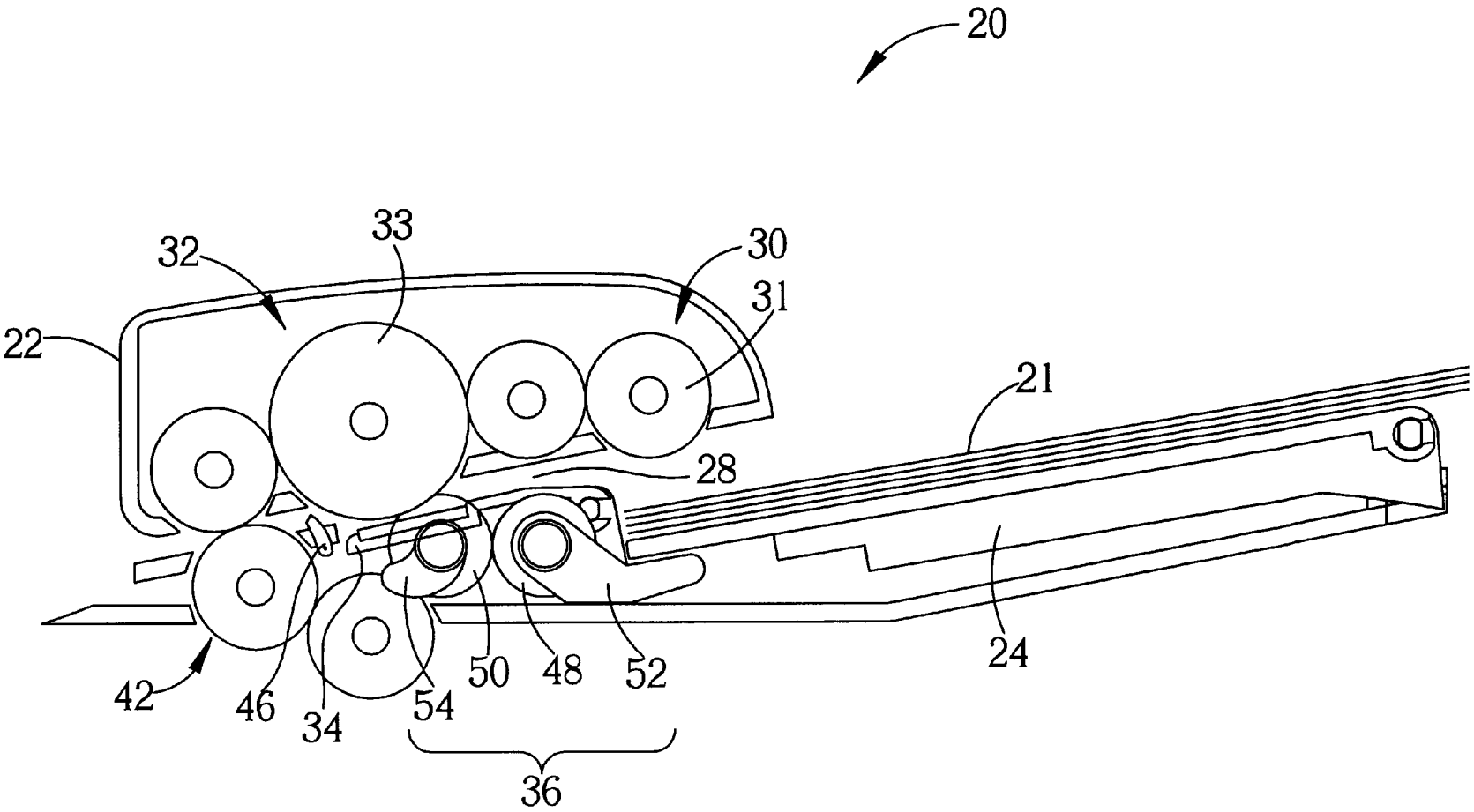
FIG. 3 is a side view of an automatic paper feeding system of the present invention.

Please refer to FIG. 3, which is a side view of an automatic paper feeding system 20 of the present invention. The automatic paper feeding system 20 comprises a housing 22; a paper tray 24 secured within the housing 22 for holding paper 21, a front end of the paper tray 24 being able to move up and down; a paper-feeding channel 28; a paper-grabbing device 30 installed above the paper tray 24; a paper-separating device 32; an actuator mechanism 36; and a driving device 38 (shown in FIG. 4). The paper tray 24 has a front end. The paper-feeding channel 28 is located in front of the front end of the paper tray 24. The paper-separating device 32 includes a paper-separating roller 33 and a paper-separating friction disk 34 installed, respectively, above and below the paper-feeding channel 28.

Figure 4:
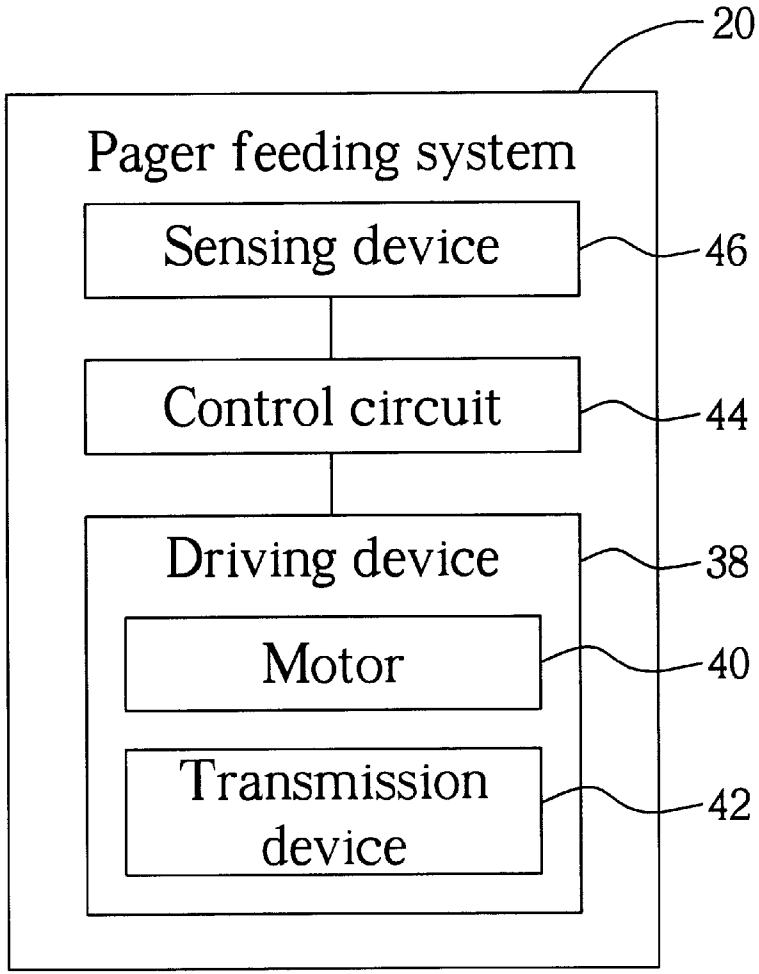
FIG. 4 is a functional block diagram of an automatic paper feeding system of the present invention.

Please refer to FIG. 4, which is a functional block diagram of the automatic paper feeding system 20 of the present invention. The driving device 38 comprises a motor 40 and a transmission device 42 for transferring power from the motor 40 to the paper-grabbing device 30, the paper-separating device 32 and to the actuator mechanism 36. The paper feeding system 20 comprises a sensing device 46 installed in the housing 22 in the rear of the paper-separating device 32 for sensing paper that passes through the paper-separating device 32. A control circuit 44 controls the rotational direction of the motor 40 depending on the output of the sensing device 46.

Referring back to FIG. 3, the paper-grabbing device 30 comprises a pick-up roller 31 rotatably secured in the housing 22. When the front end of the paper tray 24 is lifted up by the actuator mechanism 36, paper 21 in the paper tray 24 comes into contact with the pick-up roller 31 of the paper-grabbing device 30. At the same time, the driving device 38 drives the pick-up roller 31 to move the paper 21 into the paper-feeding channel 28. The actuator mechanism 36 comprises a first gear 48 engaged with a second gear 50 installed under the paper-feeding channel 28, and a first rocker 52 and a second rocker 54. One end of the first rocker 52 is installed on the first gear 48 and the other end of the first rocker 52 is installed under the front end of the paper tray 24 for driving up or down the front end of the paper tray 24. One end of the second rocker 54 is installed on the second gear 50 and the other end of the second rocker 54 is installed under the paper-separating friction disk 34 for driving the paper-separating friction disk 34 up or down.

Figure 5:
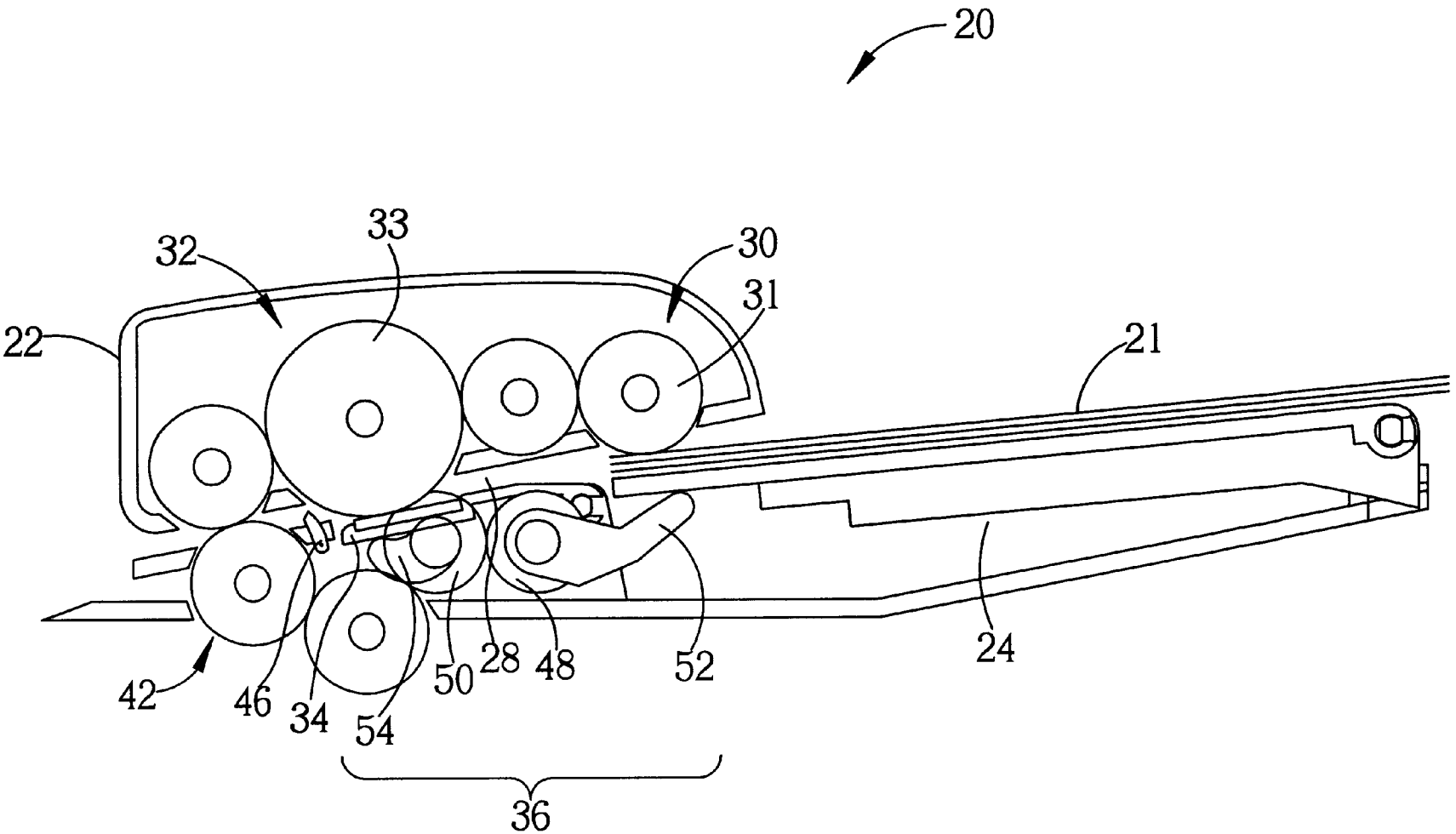
FIG. 5 is a side view of paper-feeding performed by an automatic paper feeding system of the present invention.

Please refer to FIG. 4 and FIG. 5. FIG. 5 is a side view showing paper-feeding performed by the automatic paper feeding system 20 of the present invention. When the automatic paper feeding system 20 starts to feed paper 21, the control circuit 44 triggers the driving device 38 to make the motor 40 rotate in a first direction. When the motor 40 rotates in the first direction, the transmission device 42 will drive the actuator mechanism 36 to simultaneously lift up the front end of the paper tray 24 and the paper-separating friction disk 34. When the front end of the paper tray 24 is lifted up by the actuator mechanism 36, the paper 21 in the paper tray 24 will come into contact with the pick-up roller 31 of the paper-grabbing device 30, and the driving device 38 (not shown) will drive the pick-up roller 31 to move the paper 21 in the paper tray 24 forward into the paper-feeding channel 28. When two sheets of paper 21 are moved to a contact point between the paper-separating roller 33 and the paper-separating friction disk 34, the paper closer to the paper-separating roller 33 is moved forward by the paper-separating roller 33, and the paper closer to the paper-separating friction disk 34 is stopped by the paper-separating friction disk 34. This is due to the fact that friction between the paper-separating roller 33 and the paper 21, and the friction between the paper-separating friction disk 34 and the paper 21 are greater than the friction between the two sheets of paper 21. Thus, the paper-separating roller 33 moves the sheet with which it is in contact, but leaves the other sheet on the paper-separating friction disk 34.

Figure 6:
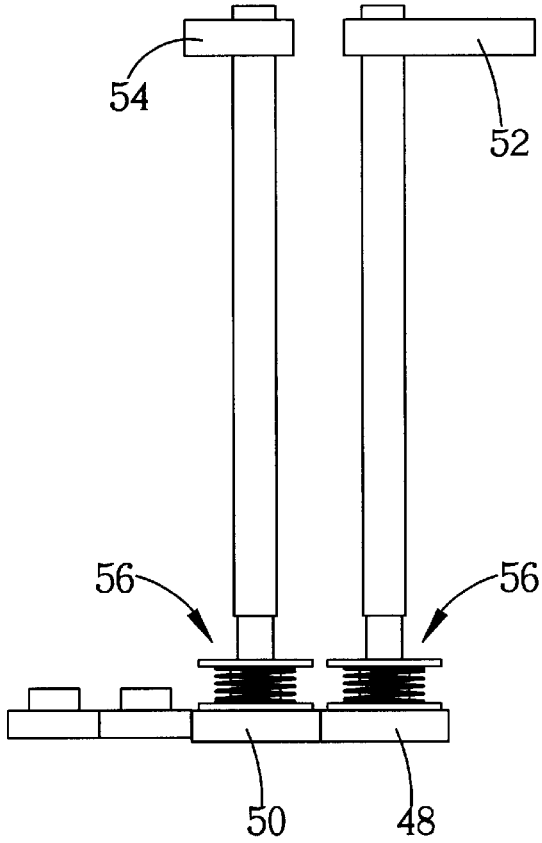
FIG. 6 is a top view of a torque limiter of an automatic paper feeding system of the present invention.

Please refer to FIG. 6, which is a top view of a torque limiter 56 of the automatic paper feeding system 20 of the present invention. During the paper-feeding process of the automatic paper feeding system 20, the transmission device 42 continuously drives the paper-grabbing device 30, the paper-separating device 32 and the actuator mechanism 36. Since the first rocker 52 and the second rocker 54 of the actuator mechanism 36 stop at their top dead points, torque limiters 56 are provided between the first rocker 52 and the first gear 48 to limit the torque on the first rocker 52 and the second rocker 54. When the first rocker 52 moves up so that the topmost sheet of paper 21 in the paper tray 24 comes into contact with the pick-up roller 31 of the paper-grabbing device 30, the torque limiter 56 will then stop the first rocker 52 from going up any farther while the transmission device 42 keeps driving the first gear 48. Similarly, another torque limiter 56 is provided between the second rocker 54 and the second gear 50. When the second rocker 54 moves up so that the paper-separating friction disk 34 comes into contact with the paper-separating roller 33, this other torque limiter 56 will then stop the second rocker 54 from going up any farther while the transmission device 42 keep driving the second gear 50.

Figure 7:
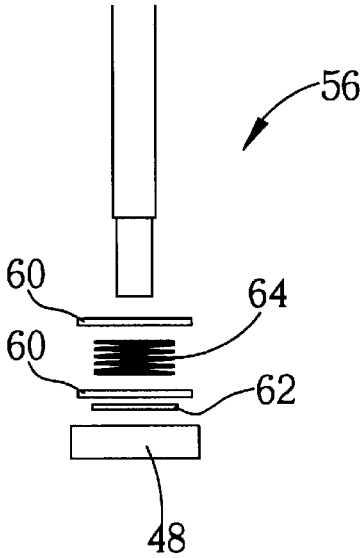
FIG. 7 is a detailed view of a torque limiter of the present invention.

Referring to FIG. 7, the torque limiter 56 comprises a spring stop plate 60, a spring 64 and a friction disk (such as a sheep mat) 62. One can use the elasticity of the spring 64 and the friction of the friction disk 62 to determine the torque of the torque limiter 56.

When the sensing device 46 detects that the front end of the paper 21 has passed the paper-separating device 32, the control circuit 44 will make the motor 40 rotate in a second direction opposite to the first direction. The transmission device 42 then drives the actuator mechanism 36 in such a way that the front end of the paper tray 24 and the paper-separating friction disk 34 are simultaneously pulled down back to their original states as shown in FIG. 3. At this time, the paper-separating roller 33 of the paper-separating device 32 can no longer move forward any paper 21 into the paper-feeding channel 28. When the sensing device 46 detects that the paper 21 has completely left the automatic paper feeding system 20, the control circuit 44 will make the motor 40 rotate in the first direction again in order to drive the transmission device 42 and continue the same paper-feeding procedure as described previously. Most business machines nowadays have a de-skewing device installed in front of the paper feeding system 20 to prevent the feeding of skewed paper. Therefore, another advantage of the present invention is that when the front end of the paper 21 leaves the paper feeding system 20 and enters the de-skewing device, the separation of the paper-separating roller 33 from the paper-separating friction disk 34 prevents putting force on the rear end of the paper 21 when the front end of the paper 21 is being de-skewed by the de-skewing device.

When compared with the paper feeding system of the prior art, the paper feeding system 20 of the present invention has both the paper-grabbing device 30 and the paper-separating device 32, which reduce situations of feeding multiple sheets of paper and the associated paper jams. The disclosed automatic paper feeding system 20 uses an actuator mechanism 36 to control the raising and lowering of the paper tray 24 and the paper-separating friction disk 34. The actuator mechanism 36 uses the operating direction of the motor 40 to determine the actuation direction. Therefore, the automatic paper feeding system 20 of the present invention requires only one set of driving devices 38 to simultaneously drive the paper-grabbing device 30, the paper-separating device 32 and the actuator mechanism 36 and to complete the entire paper-feeding process. This invention effectively reduces the number of necessary elements. In addition, since the paper-separating friction disk 34 of the paper-separating device 32 touches the paper-separating roller 33 only during the paper-feeding process, this design prevents uneven dragging of the paper 21 during a subsequent de-skewing process.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An automatic paper feeding system comprising:

a housing;

a paper tray installed within the housing for holding paper, a front end of the paper tray being able to move up and down;

a paper-feeding channel located in front of the front end of the paper tray;

a paper-grabbing device installed on the paper tray for moving paper in the paper tray into the paper-feeding channel;

a paper-separating device comprising a paper-separating roller and a paper-separating friction disk respectively installed above and below the paper-feeding channel; wherein when two sheets of paper are moved to a contact point between the paper-separating roller and the paper-separating friction disk, the paper closer to the paper-separating roller is moved forward by the paper-separating roller, and the paper closer to the paper-separating friction disk is stopped by the paper-separating friction disk;

an actuator mechanism installed under the paper-feeding channel for simultaneously lifting up or pulling down the front end of the paper tray and the paper-separating friction disk; and a driving device for simultaneously driving the paper-grabbing device, the paper-separating device and the actuator mechanism;

wherein when the driving device is activated, the actuator mechanism is driven to lift up the front end of the paper tray and the paper-separating friction disk, and when the front end of the paper tray is lifted up, the paper placed in the paper tray comes into contact with the paper-grabbing device, the paper-grabbing device moves the paper into the paper-feeding channel, and the paper-separating friction disk upwardly contacts the paper-separating roller so that the paper-separating roller continues to move the paper along the paper-feeding channel.

2. The automatic paper feeding system of claim 1 wherein a back end of the paper tray is rotatably installed outside the housing, and the front end of the paper tray moves up and down depending on the rotation of the back end of the paper tray.

3. The automatic paper feeding system of claim 1 wherein the driving device comprises a motor, and a transmission device for transferring power from the motor to the paper-grabbing device, the paper-separating device and to the actuator mechanism; wherein when the motor rotates in a predetermined direction, the transmission device drives the actuator device to simultaneously lift up the front end of the paper tray and the paper-separating friction disk, drives the paper-grabbing device to move paper in the paper tray into the paper-feeding channel, and drives the paper-separating roller to move the paper in the paper-feeding channel forward.

4. The automatic paper feeding system of claim 3 wherein the automatic paper feeding system also comprises:

a sensing device installed in the housing in front of the paper-separate device, the sensing device sensing paper that passes through the paper-separating device; and a control circuit for determining the rotational direction of the motor depending on the output of the sensing device;

wherein when the sensing device senses that a sheet of paper has passed through the paper-separating device, the control circuit makes the motor rotate in a direction opposite to the predetermined rotary direction so as to drive the actuator mechanism to simultaneously lower the front end of the paper tray and the paper-separating friction disk.

5. The automatic paper feeding system of claim 1 wherein the actuator device comprises:

a first gear and a second gear installed under the paper-feeding channel, the first and second gears engaging each other;

a first rocker for driving the front end of the paper tray up or down, wherein one end of the first rocker is installed on the first gear and the other end of the first rocker is installed under the front end of the paper tray; and a second rocker for driving up or down the paper-separating friction disk, wherein one end of the second rocker is installed on the second gear and the other end of the second rocker is installed under the paper-separating friction disk.

6. The automatic paper feeding system of claim 5 wherein a torque limiter is installed between the first rocker and the first gear; wherein when the first rocker is driven upwards to cause the paper in the paper tray to come into contact with the paper-grabbing device, the torque limiter then stops the first rocker from lifting any higher, and the first gear continues to be driven by the transmission device.

7. The automatic paper feeding system of claim 5 wherein a torque limiter is installed between the second rocker and the second gear; wherein when the second rocker is driven upwards to make the paper-separating friction disk come into contact with the paper-separating roller, the torque limiter then stops the second rocker from lifting any higher, and the second gear continues to be driven by the transmission device.

8. The automatic paper feeding system of claim 1 wherein the paper-grabbing device comprises a roller rotatably installed outside of the housing; wherein when the front end of the paper tray is lifted up by the actuator mechanism, paper in the paper tray comes into contact with the roller of the paper-grabbing device, and the driving device simultaneously drives the roller to move the paper into the paper-feeding channel.

9. An automatic paper feeding system comprising:

a housing;

a paper tray installed within the housing for holding paper, the paper tray capable of moving between a first position and a second position;

a paper-feeding channel located in front of the front end of the paper tray;

a paper-grabbing device installed on the paper tray and capable of moving paper in the paper tray into the paper-feeding channel when the paper tray is in the first position;

a paper-separating device comprising a paper-separating roller and a paper-separating friction disk, the paper-separating friction disk capable of moving to a third position to contact the paper-separating roller;

an actuator mechanism for simultaneously moving the paper tray to the first position and the paper-separating friction disk to the third position, or moving the paper tray to the second position;

wherein when the paper tray is in the first position and the paper-separating friction disk is in the third position, the paper-grabbing device contacts and moves the paper into the paper-feeding channel, and the paper-separating friction disk contacts the paper-separating roller to ensure only one sheet of paper passes the paper-feeding channel.

10. The automatic paper feeding system of claim 9 wherein the actuator device comprises:

a first gear and a second gear installed under the paper-feeding channel, the first and second gears engaging each other;

a first rocker for driving the paper tray to move between the first position and the second position, wherein one end of the first rocker is installed on the first gear and the other end of the first rocker is installed under the front end of the paper tray; and a second rocker for driving the paper-separating friction disk to move to the third position, wherein one end of the second rocker is installed on the second gear and the other end of the second rocker is installed under the paper-separating friction disk.

11. The automatic paper feeding system of claim 10 wherein a torque limiter is installed between the first rocker and the first gear; wherein when the first gear has driven the first rocker such that the paper tray has reached the first position, the torque limiter prevents the first rocker from moving any further while the first gear continues to be driven by a transmission device.

12. The automatic paper feeding system of claim 10 wherein a torque limiter is installed between the second rocker and the second gear; wherein when the second gear has driven the second rocker such that the paper-separating friction disk has reached the third position, the torque limiter prevents the second rocker from moving any further while the second gear continues to be driven by a transmission device.

* * * * *